US006676437B2

(12) United States Patent
Imaizumi

(10) Patent No.: US 6,676,437 B2
(45) Date of Patent: Jan. 13, 2004

(54) INSULATION DISPLACEMENT APPARATUS

(75) Inventor: Hiroyuki Imaizumi, Suita (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/329,374

(22) Filed: Dec. 27, 2002

(65) Prior Publication Data

US 2003/0139075 A1 Jul. 24, 2003

(30) Foreign Application Priority Data

Jan. 24, 2002 (JP) ..... 2002-015683

(51) Int. Cl.[7] ..... H01R 4/24

(52) U.S. Cl. ..... 439/395; 439/404; 439/607; 439/409; 439/417

(58) Field of Search ..... 439/395, 404, 439/409, 595, 410, 400, 536, 417, 607, 352, 405

(56) References Cited

U.S. PATENT DOCUMENTS 4,714,306 A * 12/1987 Miyazawa et al.
5,575,061 A 11/1996 Tsuji et al.
6,123,566 A * 9/2000 Daoud et al.
6,135,827 A * 10/2000 Okabe et al.
6,176,731 B1 1/2001 Aoyama
6,371,353 B1 4/2002 Ikeda
6,475,019 B1 * 11/2002 Zielke et al.

* cited by examiner

*Primary Examiner*—Dean A. Reichard
*Assistant Examiner*—Nguyen T. Ha
(74) *Attorney, Agent, or Firm*—Antonelli, Terry, Stout & Kraus, LLP

(57) ABSTRACT

Insulation displacement type contacts (3) each having a receptacle portion (9) are individually held in compartments (4) that are formed in an insulated housing (2). A stationary die (21) temporarily holds an electric connector (1) having such contacts (3). A punch (22) facing and cooperating with this die (21) will reciprocate vertically to press wire ends (15) into the receptacle portions (9) so as to establish electric connection between each wire end (15) and each portion (9). In order to protect these portions (9) from being forcibly widened when an insulation displacement operation is done, a pair of upright guards (31,32) formed integral with a supporting plate (33) are disposed in the die (21). These guards (31,32) are spaced from one another a distance equal to the sideways width of the insulated housing (2), so that its end walls (6,6) are propped up by these guards from the outside. Thus, a means is provided to protect the receptacle portions (9) from being widened, at the same time enabling this apparatus to be composed from simple and cheap parts easy to replace with each other.

3 Claims, 10 Drawing Sheets

INSULATION DISPLACEMENT APPARATUS

FIELD OF THE INVENTION

The present invention relates to an insulation displacement apparatus constructed such that unbared electric wire ends will be pressed into the respective wire end-receiving receptacle portions of a contact so as to establish a forced and direct electric connection between each wire end and each receptacle portion.

PRIOR ART

Each contact of a connector handled in and by any insulation displacement apparatus of this type does comprise a receptacle portion made of a flat piece of metal plate. This receptacle portion has a pair of piercing blades facing one another and defining between them a slot for receiving an unbared wire end covered with an insulation layer. With a punch pressing the wire end into this slot, its blades will make slits in the insulation layer so that the wire end is exposed in part and gripped fixedly due to a moderate force which those blades apply to said wire end.

There are certain cases wherein the insulation layer is made relatively thick to cover large-diameter electric wires, or the insulation layer itself is considerably hard and rigid. In these cases, a very strong stress will undesirably be imparted to the piercing blades, thus excessively widening the receptacle portion. In such an event, said blades would show a plastic deformation, failing to ensure a satisfactory effect of pressing and connecting the wire ends. A compartment for accommodation of each contact is defined between partitions to support the backs of said blades in the insulated housing. Therefore, those blades in such an excessively widened slot may cause these partitions to become permanently inclined, also resulting in a failure to establish an insulation displacement connection.

Some proposals have been made to provide a means for preventing such receptacle portions from being widened excessively in the described type contacts (see for example the Japanese Patent Laying-Open Gazette No. 7-272815, ibid. 10-326633 or ibid. 2000-340332).

In all the prior proposals, the means for prevention of an excessive widening of said receptacle portions comprised guide walls or guide pins disposed in and along both the sides of a punch reciprocating vertically to press the wire ends into the receptacle portions. These guide walls or pins were intended to bear sideways against a pair of partitions defining between them one receptacle portion. If however the connector comprises two or more insulation displacement type contacts, then the punch or the apparatus itself will become complicated to an undesirable degree. It may be very intricate or almost difficult to replace the pressing punch with another whenever the number of contacts changes. Further, it is an inevitable problem that relevant parts of such an apparatus become considerably expensive.

SUMMARY OF THE INVENTION

The present invention was made to resolve the drawbacks inherent in the prior art structures. Its object is to provide an insulation displacement apparatus comprising a means for protecting the insulation displacement receptacle portions of a connector from being widened, wherein this means is disposed in an insulation displacing stationary die that operates to temporarily hold therein the connector. Such a means employed in this invention has to be concise in its overall structure, easy to be replaced with another compatible one, and must be composed of simpler and inexpensive constituent parts.

In order to achieve the object, the present invention will provide an insulation displacement apparatus comprising an insulation displacing stationary die for holding in place a connector that comprises an insulated housing and a plurality of contacts each having a receptacle portion, with the contacts being individually held in compartments that are formed in the insulated housing. The apparatus further comprises an insulation displacing punch facing the die and driven to press unbared wire ends into the receptacle portions so as to establish electric connection between each wire end and each receptacle portion.

The apparatus provided herein is however characterized in that a pair of upright guards are disposed in the die so as to protect the receptacle portions from being widened during an insulation displacement operation, with the upright guards being spaced from each other a distance substantially equal to the sideways width of the insulated housing, so that end walls of the housing are propped up by the guards sideways from the outside while the insulation displacement operation is being carried out.

Particularly, the insulation displacement apparatus of the invention may be constructed such that the upright guards protrude integrally from opposite ends of a supporting plate capable of moving up and down in the die, so that upon delivery of the connector to be held in place on the die, the supporting plate will be driven upwards to cause its upright guards to prop up the end walls of the housing sideways and from the outside.

Preferably, the supporting plate is of a sideways width corresponding to multiple polarities of the punch having a plurality of pressing teeth integral therewith. If each connector has multiple polarities whose number is equal to the number of pressing teeth which the insulation displacing punch comprises, then the upright guards will be disposed at opposite ends of the supporting plate. In another case wherein each connector has a less number of polarities than the punch, one of the upright guards will be formed to be broader than the other so as to adjust a distance between them to correspond to the width of insulated housing of each connector. Further in this case, relief grooves will be engraved in the top of such a broadened upright guard so that idle teeth not pressing the wire ends are allowed to loosely fit in those relief grooves. Thus, one and the same insulation displacing punch can be used even if connectors having any different number of polarities are fed to the stationary die, by merely and simply replacing the supporting plate with another one. Now, a noticeably reduced number of constituent parts will suffice well to conduct easily and inexpensively the insulation displacement operation for electric connection.

THE PREFERRED EMBODIMENTS

Figure 1:
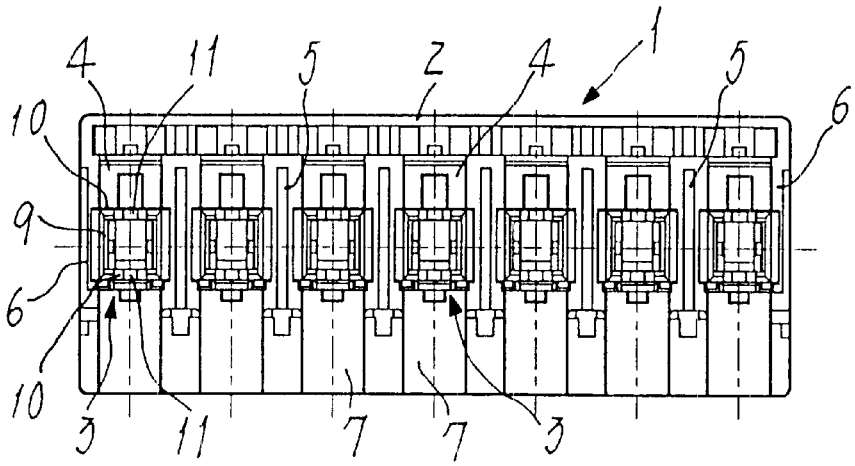
FIG. 1 is a plan view of an insulation displacement type connector to which unbared wire ends are to be secured using an apparatus of the present invention.

Now some embodiments of the present invention will be described in detail, referring to the drawings.

Figure 2:
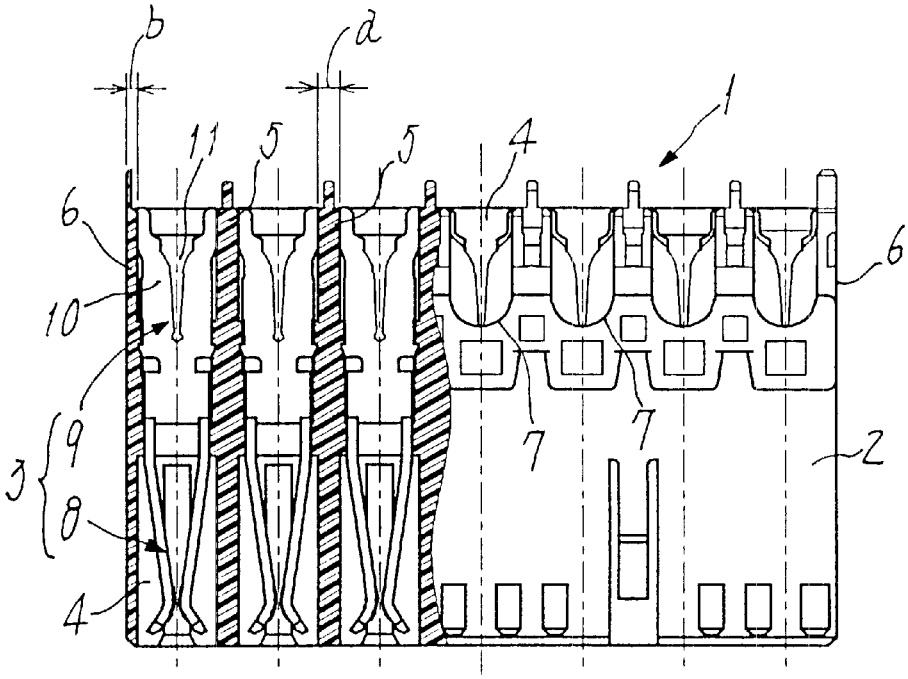
FIG. 2 is a front elevation of the connector shown partly in cross section.

FIGS. 1 and 2 show an insulation displacement type connector 1 to which a group of unbared wire ends (see FIG. 3) will be secured using an apparatus of the present invention. The connector 1 comprises an insulated housing 2 and a plurality of insulation displacement type contacts 3 accommodated therein. Formed in this insulated housing 2 that is a parallelepiped article of an insulating plastics are compartments 4 arranged side by side and at regular intervals. Thus, the contacts 3 will fit in the respective compartments 4 so as to be separated from each other in this connector. Each compartment vertically extending to have an open top and an open bottom is defined between two adjacent ones of intermediate partitions 5, or between one of the outermost partitions 5 and one of end walls 6. Each partition 5 is of a thickness 'a' that is large as twice as that 'b' of each end wall 6. Owing to this feature, if two or more connectors 1 are placed side by side in a die (detailed later) of this apparatus, all the contacts 3 will take their positions arranged at regular intervals. All of the wire ends 15 can thus be pressed simultaneously at a stroke into the respective connectors 1, conveniently to the insulation displacement type operation. Each compartment 4 has a recess 7 formed as a frontal region of its open top so as to support the wire end 15.

Each contact 3 is a piece punched off a thin conductive metal plate and bent into a designed shape. A mating connector (not shown) will engage with a contacting portion 8 of this contact 3, whose top continues to a receptacle portion 9. The receptacle portion 9 comprises a pair of flat blades 10 and 10, each having a U-shaped slot 11 into which the unbared wire end 15 will be forced. Such contacts 3 held in the respective compartments 4 are insulated from each other.

Figure 3:
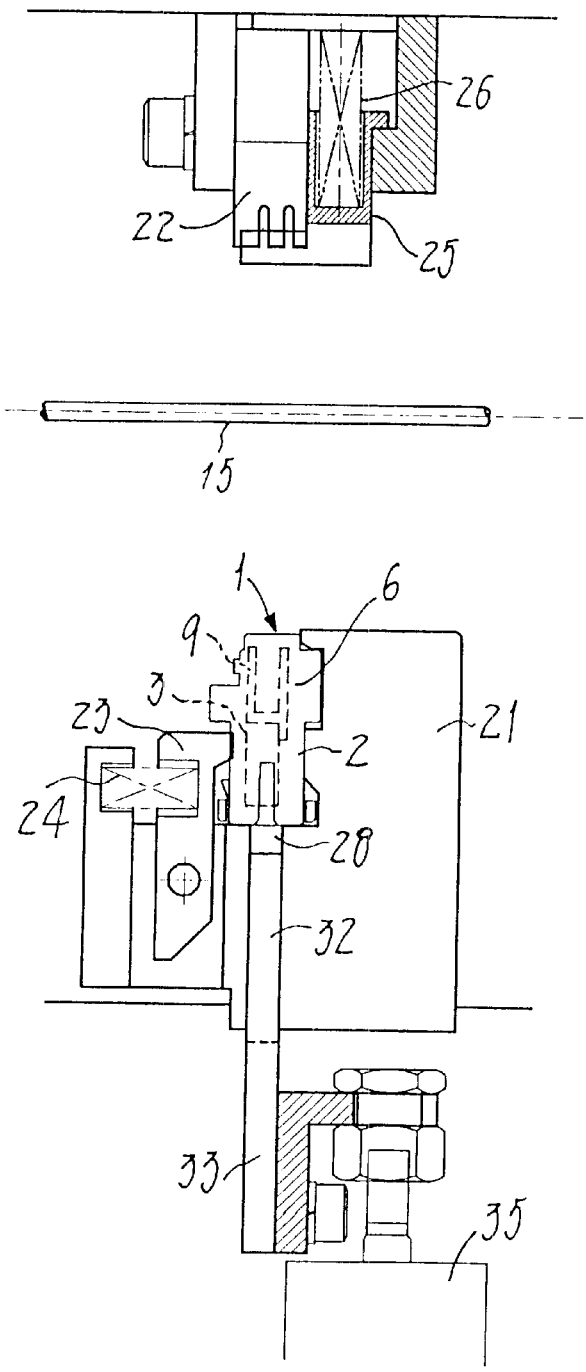
FIG. 3 is a fragmentary side elevation of the apparatus with principal parts employed in one mode of its operation.
Figure 4:
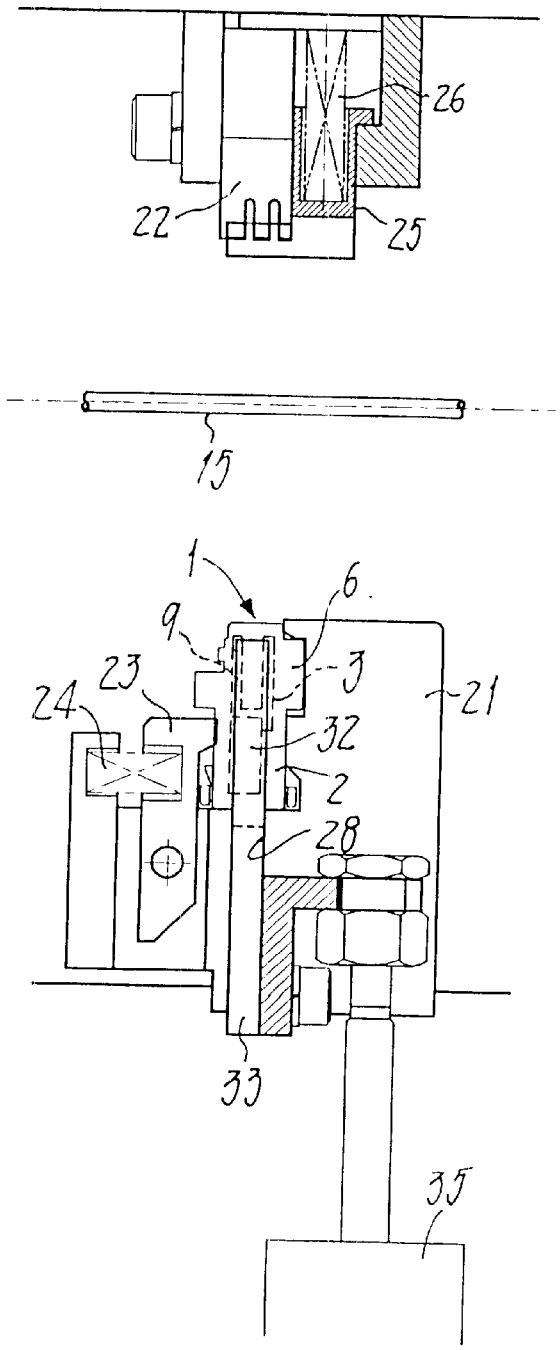
FIG. 4 is a fragmentary side elevation of the apparatus having upright guards as one of the principal parts, shown at their operative position.

FIGS. 3 and 4 show the principal parts of the apparatus of the invention, wherein an insulation displacing stationary die 21 temporarily holds the connector or connectors 1 intermittently fed to the apparatus. An insulation displacing punch 22 disposed above and facing the die 21 is another principal part of this apparatus, and both the die and punch 22 are driven up and down by an actuator not shown. The die 21 has a movable shoe 23 and a spring 24 urging this shoe in such a direction that the connector or connectors 1 will be retained at a pressing position. A further spring 26 biases a wire holding-down guide 25 of the punch 22 to slide up and down in the punch.

Figure 7:
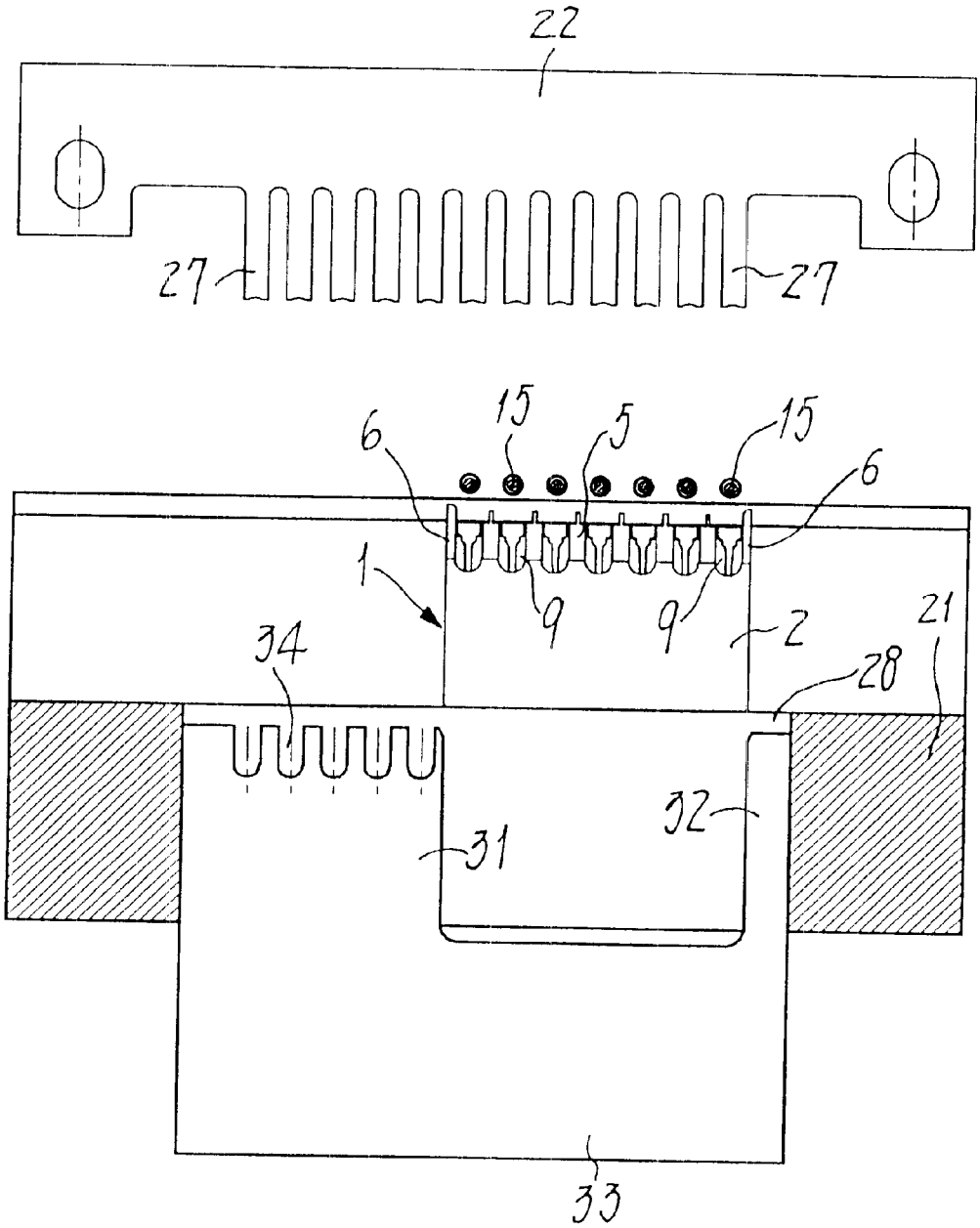
FIG. 7 is a front elevation of the apparatus shown at its position arranged to be ready to carry out the insulation displacement process.

In a mode of operation as seen in FIG. 7, the punch 22 has twelve pressing teeth 27. However, this punch may be replaced with any other one 22 that has a different number of pressing teeth 27 corresponding to the number of polarities of the connector 1.

Figure 5:
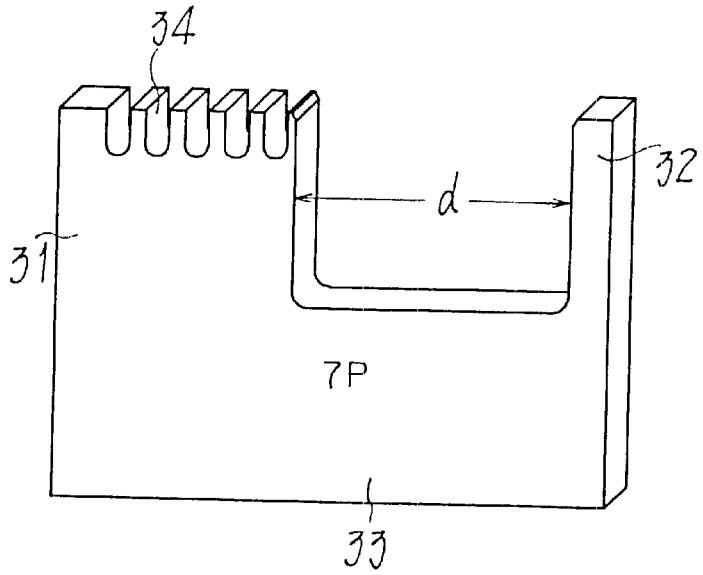
FIG. 5 is a perspective view of a supporting plate formed integral with the upright guards as said principal parts in the present apparatus.
Figure 6:
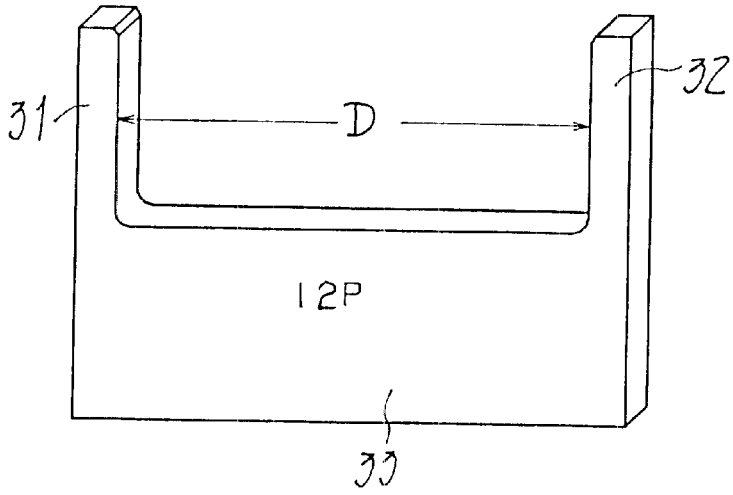
FIG. 6 is a perspective view of the supporting plate employed in another operation mode of the present apparatus.

On the other hand, the die 21 has a pair of upright guards 31 and 32 so as to inhibit the receptacle portions 9 of contacts 3 from being widened during the insulation displacement process. As shown in FIGS. 5 and 6, these guards 31 and 32 integrally protrude from opposite lateral end regions of a supporting plate 33. In a case of FIG. 5, the two upright guards 31 and 32 are shaped and sized to match connectors 1 whose number of polarities is seven (7). A distance 'd' between these guards 31 and 32 is substantially the same as the sideways width of each connector. The one guard 31 of an increased width has a top with five relief grooves 34 to loosely receive the five idle pressing teeth 27 not functioning to press the wire ends in this mode. FIG. 6 shows another example adapted for other enlarged connectors 1 whose number of polarities is twelve (12), wherein the distance 'D' between those upright guards 31 and 32 is substantially equal to sideways width of such enlarged connectors. In still another example shown in FIGS. 12 and 13, two unit connectors 61 each having six polarities are arranged side by side on the die 21 so as to work as a whole as a twelve polarity connector 1. As noted above, thickness 'b' of each end wall 6 of each unit connector 61 is half of that 'd' of each partition 5. Therefore, all the contacts 3 of such two connectors 61 are arranged at regular intervals, as if a single twelve-polarity connector 1 is subject to processing.

The supporting plate 33 having the upright guards 31 and 32 erected thereon is placed in a slot 28 formed in the die 21. This plate 33 extending through the slot 28 is capable of a sliding displacement therein in a vertical direction. As will be seen in FIGS. 3 and 4, an actuator 35 such as a pneumatic cylinder raises this plate such that its guards 31 and 32 will bear against the opposite end walls 6 and 6. Thus, the connector 1 or 61 is gripped at both the side faces of its insulated housing 2, lest any of its end walls 6 should be distorted or inclined to widen the receptacle portions.

In the described embodiment, the upright guards 31 and 32 are preferably formed integral with opposite end regions of the supporting plate 33. This structure will reduce the number of constituent parts and lower manufacture cost of this apparatus, although they may alternatively be prepared as discrete parts.

In operation, the described parts and members of the apparatus having such upright guards 31 and 32 will work to conduct the insulation displacement process.

Figure 8:
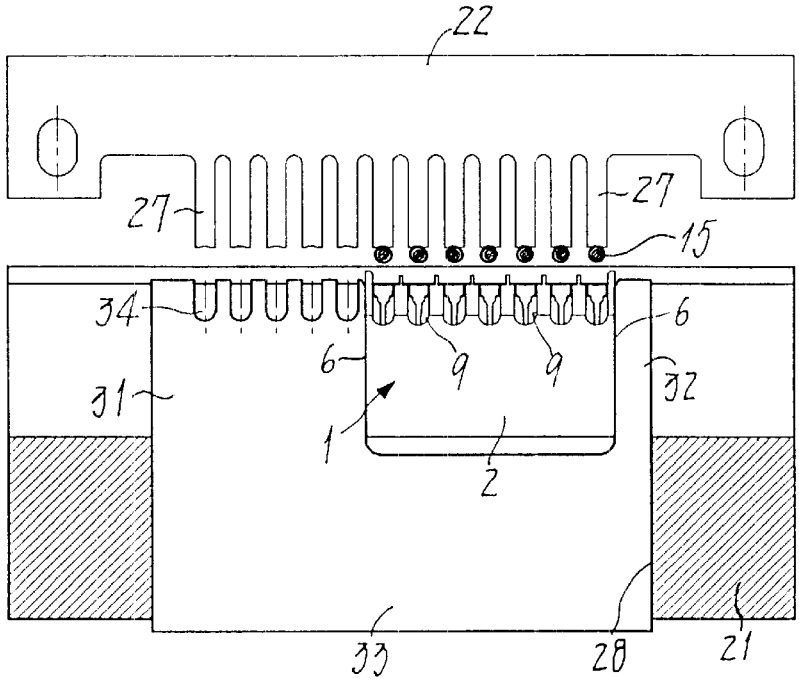
FIG. 8 is a front elevation of the apparatus shown at its further position before pushing the wire ends towards the connector.
Figure 9:
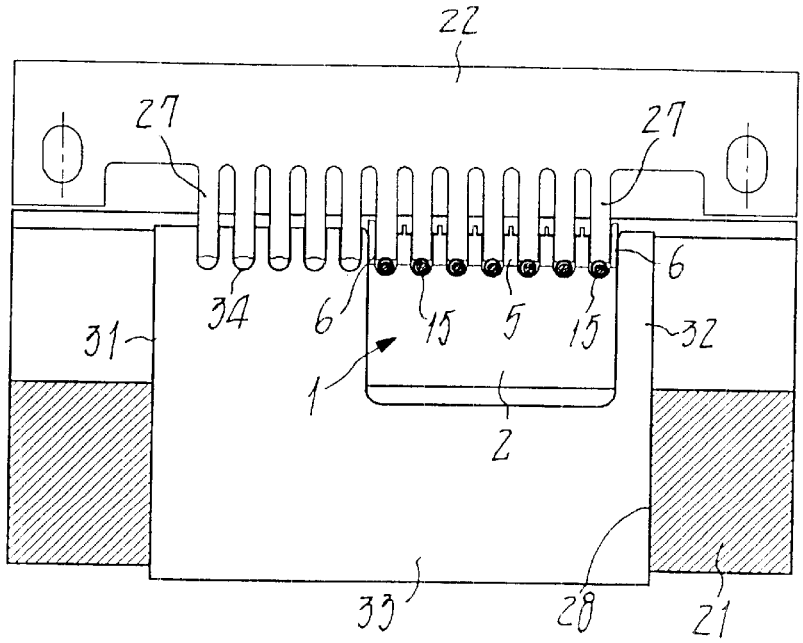
FIG. 9 is a front elevation of the apparatus shown at its still further position just forcing the wire ends into the connector.

At first, a connector feeder not shown will deliver a connector 1 to the die 21 to be held in position shown in FIGS. 3 and 7, before the pneumatic cylinder 35 lifts the supporting plate 33. As a result, its guards 31 and 32 come into contact with the end walls 6 to thereby grip this connector as shown in FIGS. 4 and 8. On the other hand, seven lengths of electric wires 15 from a wire feeder not shown are set in position above and facing the seven polarities, viz., seven contacts 3 of this connector. The punch 22 will subsequently be driven to descend as seen in FIG. 9 so that its pressing teeth 27 facing the respective contacts do force the wire ends 15 at once into the receptacle portions 9. The two slots 11 belonging to each receptacle portion 9 will thus receive one of the wire ends. Edges serving as blades facing one another to define each slot 11 do consequently pierce the insulation layer of wire end. Slits thus produced in the insulation layer are effective to expose in part a conductive core of this wire end, such that the blades 10 grip it with a moderate force. In this manner, the unbared wire ends 15 are directly brought into electric connection to the respective contacts 3. Idle teeth 27 not pressing the wire ends loosely fit in the relief grooves 34 formed in the supporting plate 31. The force applied to each wire end 15 and thrusting it into the slots 11 will tend to deform and widen the receptacle portion 9. However, intermediate ones of contacts 3 located not at but between opposite ends of the insulated housing 2 will not suffer from any adverse effect to become inclined due to such a thrust. This is because each partition 5 intervening between the two adjacent compartments 4 receives such a force's portions acting in opposite directions and thus canceling one another. Each contact 3 located at one of the side ends of insulated housing 2 tends to incline the end wall 6, but it is propped up inwardly by the upright guard 31 or 32 so as not to become inclined or collapsed to widen the receptacle portion 9. All the receptacle portions 9 of the intermediate and sideways-end contacts 3 are thus protected from being widened.

Figure 10:
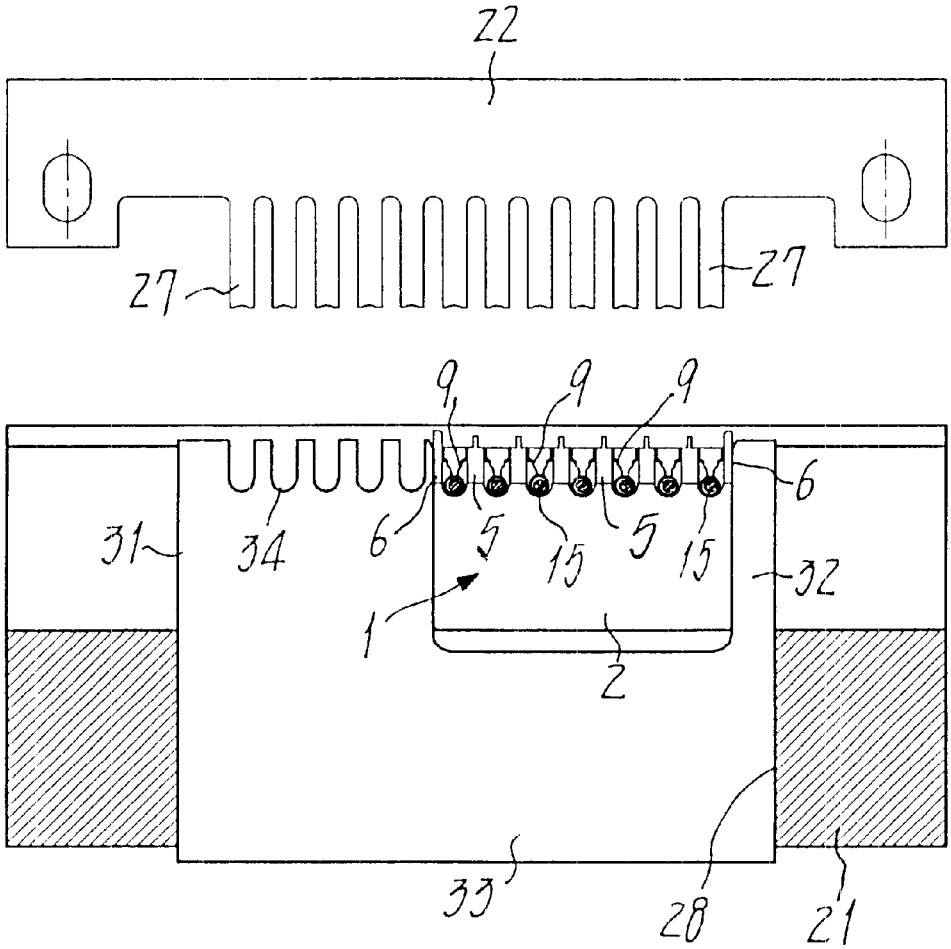
FIG. 10 is a front elevation of the apparatus shown at its yet still further position having pressed the wire ends in the connector.
Figure 11:
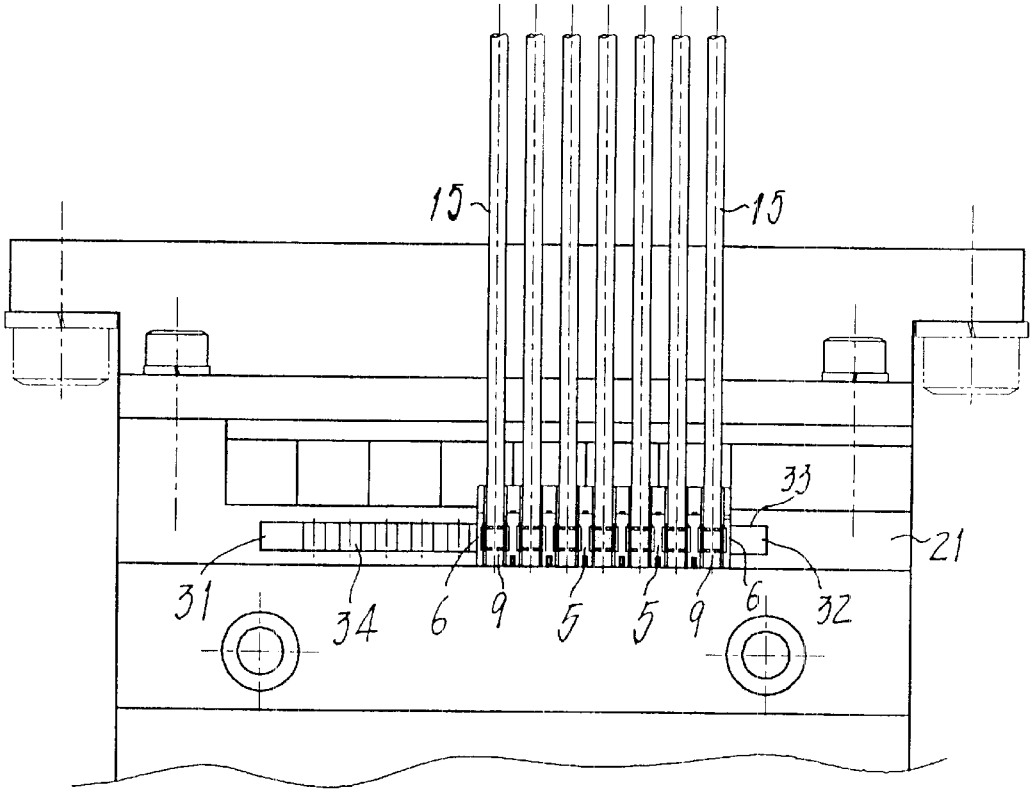
FIG. 11 is a plan view corresponding to FIG. 10.

Upon completion of the insulation displacement process for connecting the unbared wire ends 15 to the connector 1, the punch 22 will be raised upwards away from the die 21 as seen in FIG. 10. However, the end walls 6 and 6 of this connector 1 at this step still remain gripped with the upright guards 31 and 32, it will be held in place not to accompany the rising punch 22. Subsequent to such a removal of the punch 22, the supporting plate 33 will be lowered to free the end walls of the connector 1, thereby making it possible to eject it together with the wire ends 15, out of the die 21.

Figure 12:
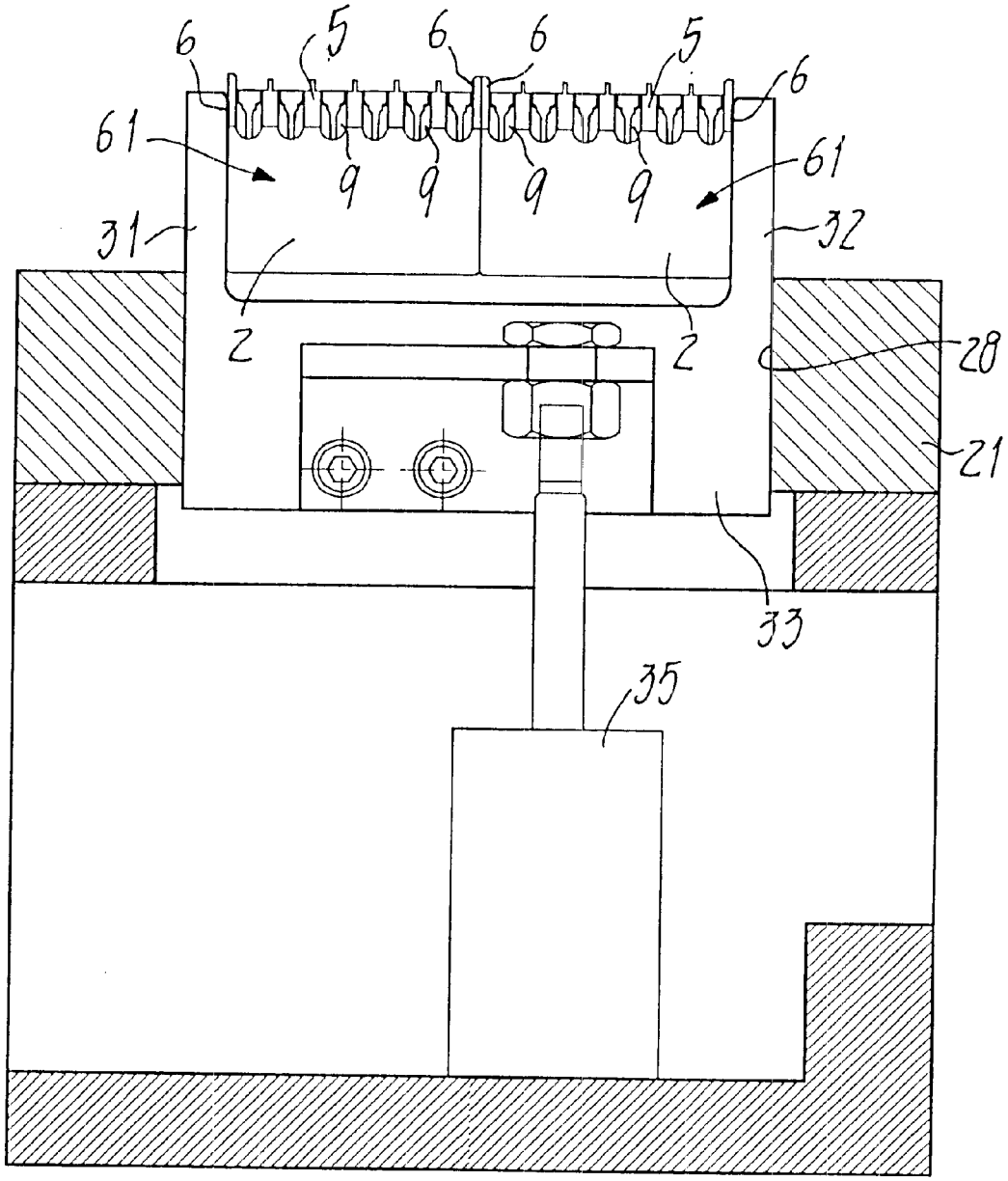
FIG. 12 is front elevation of the principal parts in still another operation mode of the present apparatus.
Figure 13:
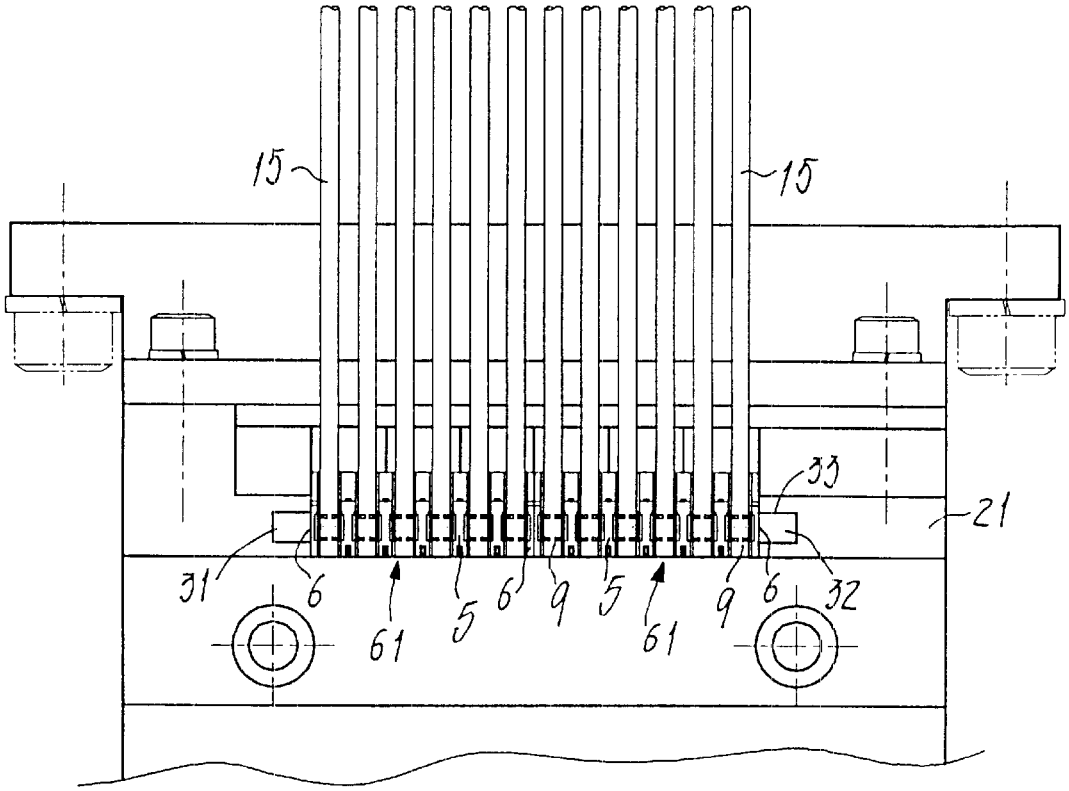
FIG. 13 is a plan view corresponding to FIG. 12, but shown at its position having completed its one cycle in the insulation displacement process.

FIGS. 12 and 13 show a case wherein the supporting plates 33 with it upright guards 31 and 32 arranged to match a twelve-polarity connector as shown in FIG. 6. In this case, two six-polarity connectors 61 will be set in position side by side on the die 21 so that the twelve unbared wire ends 15 are put into insulation displacement connection at once to both the connectors 61. All of their contacts 3 will be protected from deformation otherwise causing them to be widened, in a manner similarly to the preceding embodiment.

It will now be apparent that the connector delivered to the die is propped up at its end walls by the pair of upright guards, during the insulation displacement process. These end walls are protected from falling or deformation, thus inhibiting the sideways-end contacts adjacent to them from widening their receptacle portions. On the other hand, the intermediate contacts each located between the adjacent partitions are also protected spontaneously and surely from such a widening deformation of their receptacle portions. This is because, as noted above, each partition between the two adjacent compartments receives two forces of the same strength but acting in opposite directions to cancel one another. The receptacle portions of all contacts will now be protected in a reliable manner from the widening deformation.

As set forth in the accompanying claim 2, the one and the same punch may be used in combination with a few or several supporting plates whose pairs of upright guards are spaced different distances from each other. By replacing the supporting plate with another one, this apparatus can operate efficiently for various connectors having different numbers of polarities.

What is claimed is:

1. An insulation displacement apparatus comprising:

an insulation displacing stationary die for holding in place a connector that comprises an insulated housing and contacts each having a receptacle portion, with the contacts being individually held in compartments that are formed in the insulated housing, an insulation displacing punch facing the die and driven to press wire ends into the receptacle portions so as to establish electric connection between each wire end and each receptacle portion, and a pair of upright guards for protecting the receptacle portions from being widened during an insulation displacement operation, with the upright guards being disposed in the die and spaced from one another a distance substantially equal to the sideways width of the insulated housing, so that end walls of the housing are propped up by the guards sideways from the outside while the insulation displacement operation is being carried out.

2. An insulation displacement apparatus as defined in claim 1, wherein the upright guards protrude integrally from opposite ends of a supporting plate capable of moving up and down in the die, so that upon delivery of the connector to be held in place on the die, the supporting plate will be driven upwards to cause its upright guards to prop up the end walls of the housing sideways and from the outside.

3. An insulation displacement apparatus comprising:

an insulation displacing stationary die for holding in place a connector that comprises an insulated housing and contacts each having a receptacle portion, with the contacts being individually held in compartments that are formed in the insulated housing, an insulation displacing punch facing the die and driven to press wire ends into the receptacle portions so as to establish electric connection between each wire end and each receptacle portion, and a pair of upright guards that protrude integrally from opposite ends of at least one supporting plate for protecting the receptacle portions from being widened during an insulation displacement operation, with the upright guards being disposed in the die and spaced from one another a distance substantially equal to the sideways width of the insulated housing, so that end walls of the housing are propped up by the guards sideways from the outside while the insulation displacement operation is being carried out.

* * * * *